United States Patent [19]

Flinn

[11] 3,944,174

[45] Mar. 16, 1976

[54] DERAIL WHEEL CROWDER

[75] Inventor: Leo E. Flinn, Countryside, Ill.

[73] Assignee: Federal Sign and Signal Corporation, Blue Island, Ill.

[22] Filed: Sept. 20, 1974

[21] Appl. No.: 507,944

[52] U.S. Cl. ..... 246/163; 104/257

[51] Int. Cl.[2] ..... B61L 19/04

[58] Field of Search ..... 246/163; 104/257

[56] References Cited

UNITED STATES PATENTS

| | | | |
|---|---|---|---|
| 725,316 | 4/1903 | Carter | 246/163 |
| 795,342 | 7/1905 | Clausen | 246/163 |
| 2,829,246 | 4/1958 | Hayes | 246/163 |

*Primary Examiner*—Trygve M. Blix
*Assistant Examiner*—Reinhard J. Eisenzopf
*Attorney, Agent, or Firm*—Charles F. Pigott, Jr.

[57] ABSTRACT

A wheel crowder for mounting on a rail opposite a conventional derail for cooperation with the latter whereby the wheel crowder engages a wheel of a railcar or locomotive and forces the same toward the derail thereby assuring that the opposite wheel will move into the throat or entering toe of the derail and permit proper operation of the latter.

8 Claims, 6 Drawing Figures

14
18
20
16
$R_R$
$R_L$
$T_2$
116'
122
120
124
118
80
90
92
88
78
106
98
94
34
32
62
58
60
46
42
36
24
44
128

14
18
20
16
$R_R$
$R_L$
$T_2$
116'
122
120
124
80
88
98
106
94
34
32
62
58
48
42
36
24
44
128

$T_1$
$T_2$
30
40
36
42
44
64
60
66
62
58
68
32
26
124
128
130
38
24

138
6.
14'
$R_L$
$R_R$
$T_1'$
$T_2'$
140
132
136'
142
134
144
148
150
154
152
156
70'
72'
74'
76'
90'
92'
94'
96'
98'
104'
106'
110'
30'
32'
34'
36'
44'
56'
58'
24'
136
116'
142'

DERAIL WHEEL CROWDER

BRIEF SUMMARY OF THE INVENTION

Derails have been used for many years to derail a runaway railcar or locomotive where it is desired to assure that such equipment will not pass beyond a designated area along a railroad track. An example of a known type of derail is described in U.S. Pat. No. 2,829,246 which is assigned to the assignee of the present invention.

Under normal conditions, a conventional derail of the type described in the above-identified patent will perform its intended function and derail a moving railcar or locomotive. However, under certain somewhat abnormal conditions, a conventional derail will not necessarily be able to derail a runaway railcar or locomotive at high speeds, thus presenting a serious safety hazard. For example, where a derail is installed on a curved section of track, it should preferably be installed on the outside rail, because centrifugal force will cause the car to shift toward the outside rail on the curve. However, if because of existing conditions it is necessary to install a derail on the inside rail of a curve, the outside wheels will be caused to crowd the outside rail, and as a result a serious risk is created that the inside wheels may by-pass the throat or entering point of the derail.

It is therefore a general object of the present invention to provide a wheel crowder which is mounted on a rail opposite a derail and serves to assure proper operation of the latter by engaging successive wheels of railcars or locomotives and thereby crowding or pushing each opposite wheel into the throat or entering toe of the derail.

Another object is to provide a wheel crowder which is actuated by the same mechanism which actuates the derail and may be used in conjunction with either a sliding or hinged-type derail.

The foregoing and other objects and advantages of the invention will be apparent from the following description of certain preferred embodiments thereof, taken in conjunction with the accompanying drawings:

Now, in order to acquaint those skilled in the art with the manner of making and using my invention, I shall describe, in conjunction with the accompanying drawings, certain preferred embodiments of the invention.

DETAILED DESCRIPTION OF THE INVENTION

Figure 1:
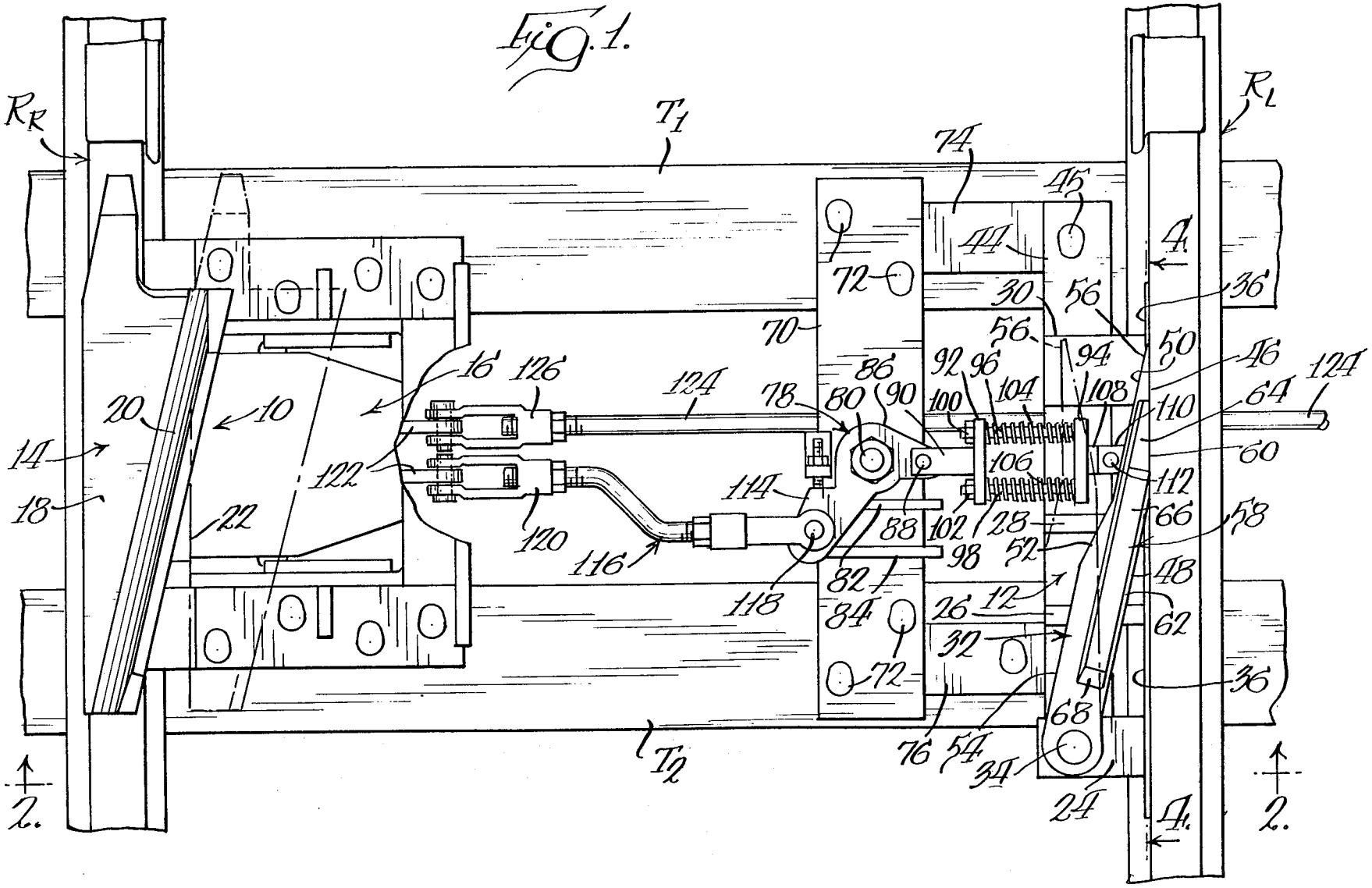
FIG. 1 is a top plan view of a wheel crowder constructed in accordance with the present invention and mounted on a rail opposite a sliding derail so as to be actuated by the same mechanism which actuates the sliding derail.

Referring now to the drawings, FIG. 1 shows a section of rail track comprising a left-hand rail $R_L$ and a right-hand rail $R_r$ mounted on cross ties $T_1$ and $T_2$. A conventional derail 10 is mounted in association with the rail $R_r$, and a wheel crowder 12 is mounted in association with the opposite rail $R_L$. The derail 10 comprises a derail shoe 14 and a guiding portion 16, the derail shoe being of composite welded construction and welded to the rear or guiding portion. A baseplate 18 is adapted to overlie or rest on the head of the rail $R_r$ when the derail is in operative position. The derail further includes a deflecting bar 20 and a trailing pad 22. For a more detailed description of the derail 10, reference may be had to U.S. Pat. No. 2,829,246.

Referring to FIGS. 1–4, the wheel crowder assembly 12 includes supporting structure comprising four horizontal guide blocks or plates 24, 26, 28 and 30 (see FIG. 1). The foregoing blocks or plates define a horizontal support plane for supporting a crowder bar 32. The crowder bar 32 is mounted for pivotal movement about an upright pivot shaft 34 which is journalled in the first-mentioned support block 24. Each of the foregoing support blocks 24, 26, 28 and 30 is welded to a common mounting plate 36 which is bolted or otherwise affixed to the rail $R_L$ as shown at 38 and 40 (see FIG. 4). It will be seen that an upper face or top surface 42 of the mounting plate 36 is approximately coplanar with the above-mentioned horizontal support plane on which the crowder bar 32 is supported and is slidable about pivot shaft 34. In addition, a common bottom mounting plate 44 is welded to the underside of the support blocks 24, 26, 28 and 30. The plate 44 extends transversely between the ties $T_1$ and $T_2$ and is anchored thereto by conventional spikes or the like 45 as shown in FIG. 1.

Figure 2:
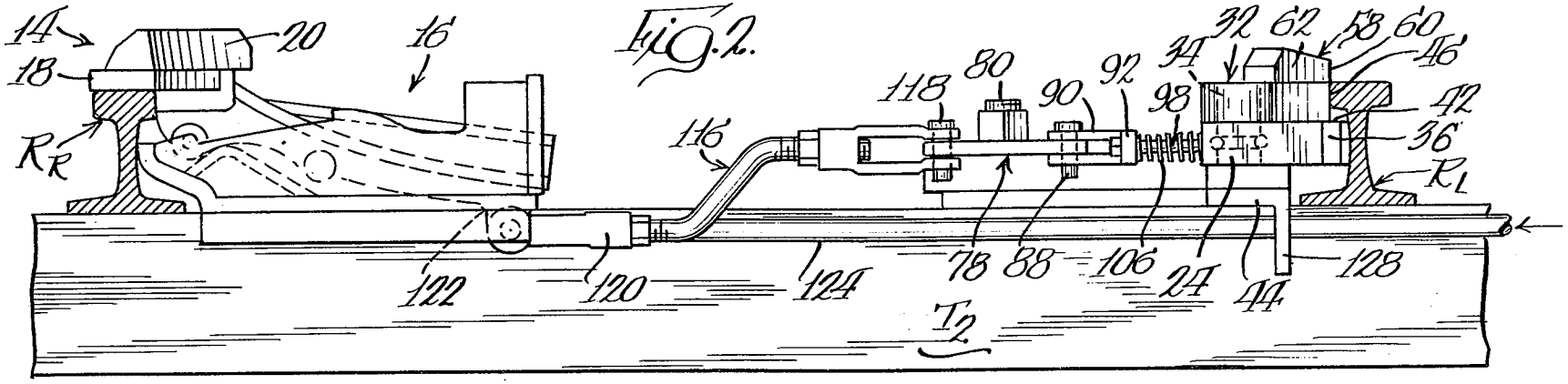
FIG. 2 is a side elevational view looking approximately in the direction of the arrows 2—2 of FIG. 1 and showing the wheel crowder and the derail in their operative positions.
Figure 3:
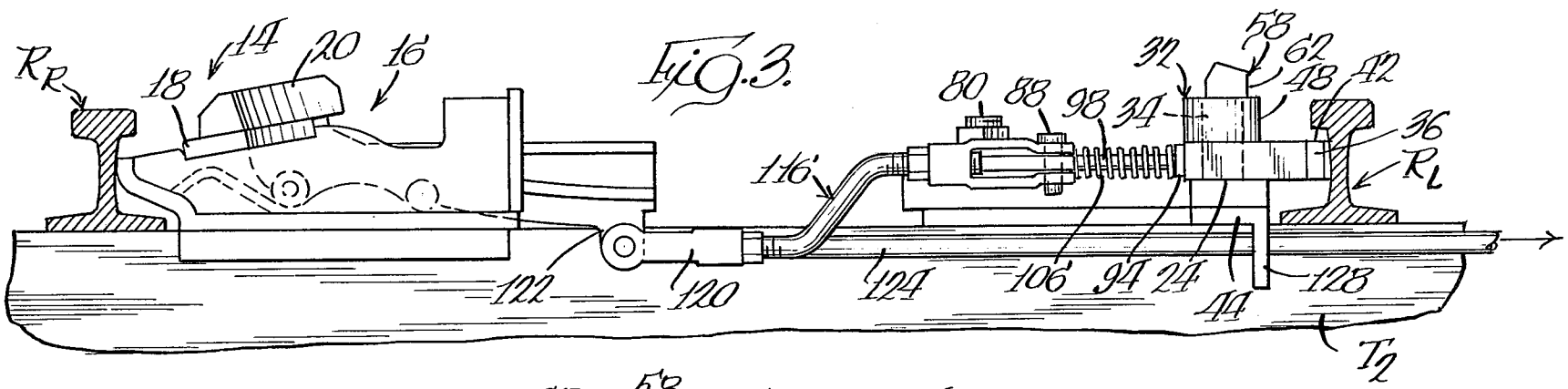
FIG. 3 is a side elevational view similar to FIG 2 showing the derail and wheel crowder in their inoperative positions.

The crowder bar 32 is pivotally movable between an operative position as shown in solid lines in FIG. 1 and an inoperative position as shown in dash lines therein. When in its operative position, the crowder bar abuts against the inside of the upper section of the rail $R_L$ as best shown in FIG. 2, and when in its inoperative position it is spaced inwardly from the rail as shown in FIG. 3. The crowder bar 32 has a flat side wall 46 at the outer end thereof, and a flat and somewhat longer side wall 48 at the inner end thereof which is inclined to the wall 46. The opposite side of the crowder bar 32 as shown in FIG. 1 comprises substantially flat surfaces 50, 52 and 54. The crowder bar is oriented so that when in its operative position the side wall 46 lies substantially flat against the inside of the upper rail section as shown in FIG. 1. It will further be noted that the opposed side walls 46 and 50 define a small included angle in the approximate range of 10 to 15 degrees, thereby providing the bar 32 with a rather narrow end or tip portion 56.

Figure 4:
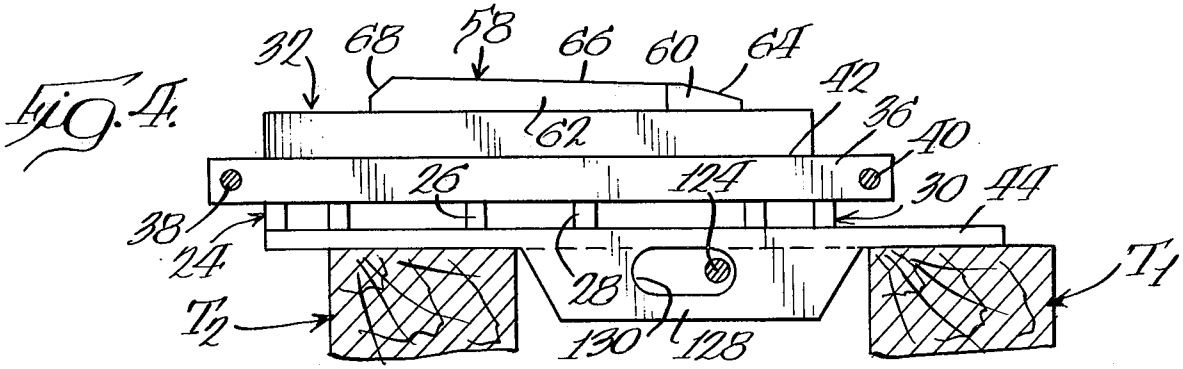
FIG. 4 is a sectional view taken substantially along the line 4—4 of FIG. 1.

A raiser bar 58 is welded to the upper surface of the crowder bar 32. The raiser bar 58 has inclined outer side walls 60 and 62, the side wall 60 being approximately coplanar with the crowder bar side wall 46, and the side wall 62 being spaced inwardly somewhat from the crowder bar side wall 48. As best shown in FIG. 4, the upper surface of the raiser bar 58 comprises an upwardly sloping entry surface 64, a relatively long surface 66 which is slightly inclined upwardly from right to left as shown in the drawing, and a downwardly sloping surface 68.

The mechanism for actuating the crowder bar 32 will now be described. A support plate 70 (see FIG. 1) extends between the ties $T_1$ and $T_2$ and is anchored thereto by a plurality of spikes or the like 72. Additional support plates 74 and 76 may be provided which extend parallel to the ties between the plates 44 and 70. A bellcrank member 78 is supported on the plate 70 for pivotal movement about a pivot shaft 80, and a pair of upright plates 82 and 84 are welded to the support plate 70 to guide and support the bellcrank during its pivotal movement.

One arm 86 of the bellcrank 78 is connected by a pivot shaft 88 to a bar 90 which is welded to a cross-bar 92. A second cross-bar 94 has a pair of bolts 96 and 98 welded thereto which extend through openings in the cross-bar 90 and have nuts 100 and 102 fastened on the ends thereof. A pair of compression springs 104 and 106 are mounted on the bolts 96 and 98 between the cross-bars 92 and 94, and each of the springs is preloaded to 64 pounds for a total pre-load of 128 pounds. The cross-bar 94 has a bar or lug 108 welded thereto, and a bar or lug 110 is welded to the underside of the crowder bar 32, the bars 108 and 110 being interconnected by a pivot shaft 112.

A second bellcrank arm 114 is pivotally connected to a rod 116 by a pin 118, and the rod 116 carries a turnbuckle 120 which is pivotally connected to an arm or lug 122 which forms a part of the slidable derail 14. A main actuating rod 124 (see FIG. 1) for the derail 14 is connected to the arm or lug 122 by a turnbuckle 126. As viewed in FIG. 1, the actuating rod 124 extends to the right underneath the rail $R_L$, and as shown in FIG. 4 a downwardly extending plate 128 is welded to the underside of the mounting plate 44 and has an opening 130 through which the actuating rod 124 passes. The rod 124 extends to an operating stand (not shown) for either manual or automatic operation of the derail 14 as desired. It will now be understood that when the rod 124 is moved to the left as viewed in FIG. 1, the derail 14 is moved into its operative position on top of the rail $R_r$, and when the rod 124 is moved to the right, the derail is moved to its inoperative position as shown in FIG. 3.

The wheel crowder member 32 is actuated conjointly with the derail 14 by the rod 116 which moves with the rod 124 and is connected to bellcrank arm 114. Thus, when the rods 124 and 116 move to the left as viewed in FIG. 1, the bellcrank 78 is pivoted in a clockwise direction causing transmission of a force through plate 92, springs 104 and 106, plate 94, bar 108 and shaft 112 so as to pivot the crowder bar 32 into its operative position against the upper section of the rail $R_L$. Such a force can readily be transmitted through the springs 104 and 106 due to the above-mentioned 128 pounds pre-load on the springs. Similarly, when the rod 124 is moved to the right as viewed in FIG. 1, the bellcrank 78 is pivoted in a counterclockwise direction causing the crowder bar 32 to be pivoted about shaft 34 to its inoperative position as shown in FIG. 3 and also in dash lines in FIG. 1. In the latter instance, the force is transmitted through the bolts 96 and 98 rather than the compression springs 104 and 106.

The operation of the foregoing apparatus will now be briefly described. When the derail 14 and crowder bar 32 are in operative position as viewed in FIG. 1 with the top surface of the crowder bar approximately coplanar with the top of the rail as shown in FIG. 2, and a runaway car or locomotive is moving along the rails in the intended direction (from top to bottom as viewed in plan in FIG. 1), the flange on each lefthand wheel will engage the inner side wall 56 of the crowder bar 32 thereby crowding the wheel inwardly toward the opposite rail and causing the opposite wheel to enter the throat or entering toe of the derail 14. As the lefthand wheel progresses forwardly, the wheel flange will engage the sidewall surface 52 on the crowder bar thereby further assisting in the crowding of the wheel toward the opposite rail to assist in the proper operation of the derail 14 in derailing the rolling equipment toward the right side of the track, i.e., to the left as viewed in FIG. 1. It will further be noted that each wheel engaging the crowder bar 32 will ride up on the raiser bar 58, so that each successive wheel will be elevated while the same is being pushed toward the opposite rail.

The derail 14 is designed to derail equipment approaching from a given direction, e.g., from top to bottom as viewed in plan in FIG. 1. However, if a car or locomotive should approach in the opposite direction, the successive wheels can pass over the derail 14 and remain on the rail as is described more fully in the above-mentioned U.S. Pat. No. 2,829,246. Moreover, the crowder bar 32 of the present invention is designed to permit passage of rolling equipment moving in the opposite direction. Thus, if a wheel approaches the crowder bar 32 from the opposite direction, the wheel flange will engage the side walls 48 and 46 of the crowder bar and cam the latter out of the way by overcoming the pre-load on the two compression springs 104 and 106 and causing the bolts 96 and 98 to move relative to the cross bar 92. In the foregoing manner, the yieldable connection afforded by the compression springs 104 and 106 permits equipment moving in the opposite direction along the rails to pass by the crowder bar 32 without interference and without damaging the crowder bar related mechanism.

Figures 5, 6:
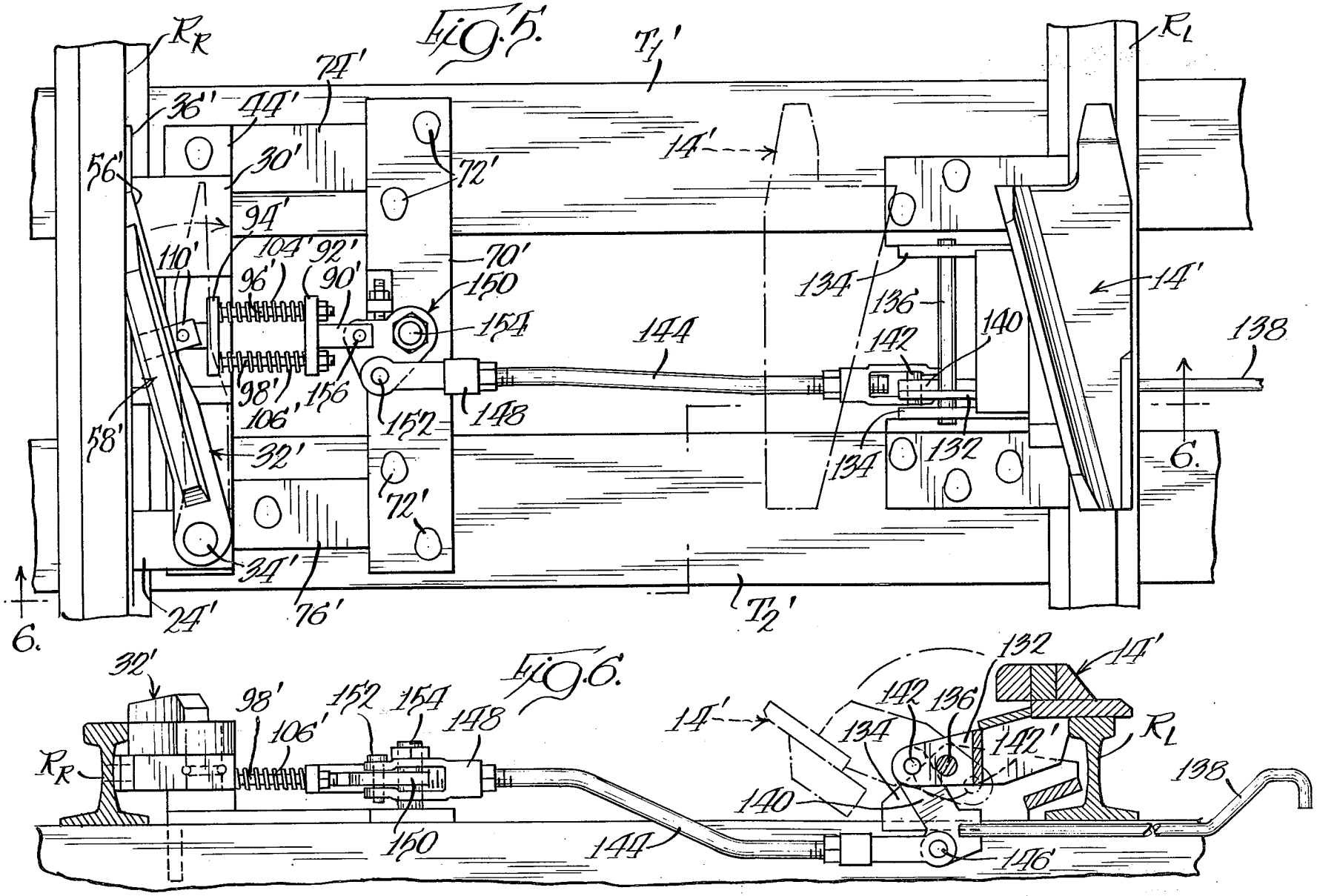
FIG. 5 is a top plan view of an alternative embodiment showing a wheel crowder constructed in accordance with the present invention mounted on a rail opposite a hinged-type derail so as to be actuated conjointly with the hinged-type derail when the latter is manually pivoted between its operative and inoperative positions and FIG. 6 is a sectional view taken substantially along the line 6—6 of FIG. 5.

FIGS. 5 and 6 illustrate an alternative embodiment of the invention where a wheel crowder is mounted for cooperation with a hinged-type derail. With the exception of the bellcrank and means for actuating the latter, the crowder bar shown in FIGS. 5 and 6 is the same as described in conjunction with FIGS. 1–4 and will therefore be identified by corresponding primed reference numerals. Moreover, a derail 14' as shown in FIGS. 5 and 6 functions in the same manner as the derail described in FIGS. 1–4, except that the derail 14' pivots rather than slides when moved between its operative and inoperative positions. Thus, the derail 14' includes a pair of lugs 132 and 134 which are mounted on a fixed pivot shaft 136, whereby the derail is manually pivoted about the hinge or pivot shaft 136 to move the derail between the operative position shown in solid lines and the inoperative position shown in dash lines.

A hinged-type derail as shown in FIGS. 5 and 6 is actuated by manually throwing the same over in a vertical semicircle on and off the rail, and normally such derails are not operated by stand or pipe line or by remote control. However, if desired a target stand may be provided to indicate the position of the derail, and there is shown a rod 138 provided for actuating such a target stand (not shown). The rod 138 is mounted on a link 140 which is pivotally connected at one end to the derail lug 132 by a pin 142, and is pivotally connected at its other end to an actuating rod 144 by a pin 146. The opposite end of the rod 144 carries a turnbuckle 148 which is pivotally connected to a bellcrank 150 by a pin 152. The bellcrank 150 is supported above the mounting plate 70' for pivotal movement on a shaft 154, and the bellcrank is further connected to the actuating bar 90' by a pin 156. It will now be understood that when the derail 14' is pivoted to the operative position shown in solid lines in FIGS. 5 and 6, link 140 causes rod 144 to be moved to the left thereby pivoting the bellcrank in a clockwise direction as viewed in FIG. 5 so as to move crowder bar 58' to its operative position in engagement with the side of the upper section of rail $R_R$. In a similar manner, when the derail 14' is moved about the shaft 136 to its inoperative position as shown in dash lines in FIGS. 5 and 6, pin 142 is swung around to the position shown at 142' and link 140 thus pulls rod 144 toward the right causing bellcrank 150 to move in a counterclockwise direction pulling bar 90' away from the rail $R_R$ and moving crowder bar 32' to its inoperative position in spaced relation to the rail $R_R$.

It will be seen from the foregoing description that the wheel crowder of the present invention is uniquely suited to assist a conventional derail under abnormal conditions, as for example where derails are installed on the inside rail of curves so that the flange of the wheel may by-pass the throat or entering point at the toe of the derail. The wheel crowder will push or shove the wheels into the throat or entering toe of the derail to assure proper functioning of the latter even under the most difficult conditions. Thus, in certain situations on industry tracks and in many other locations where buildings or obstructions prevent the proper placing of derails on the high or outside rail of a curve, a conventional derail may still be utilized with assurance of proper operation where the same is used in combination with a wheel crowder in accordance with the present invention.

The derail and wheel crowder combination may be installed at less cost than switch-point type derails. In addition, if a derail is required in welded rail territory, such as at railroad crossings or in car-repair tracks in yards, the wheel crowder in conjunction with a derail will provide more positive action without requiring cutting of the running rails. The present invention therefore offers particularly advantages where it is necessary to install derails on the inside rails of curves, on grades descending toward main tracks, at one-spot car-repair shops, and on all industry tracks that come under OSHA rulings.

I claim:

1. A wheel crowder for use in combination with a derail for mounting on a rail opposite the derail to assist in operation of the latter, said wheel crowder comprising, in combination, a crowder bar located along the inside of a first rail opposite a second rail on which a derail is mounted, said crowder bar being movable between an operative position where it engages the inside of said first rail and an inoperative position where it is spaced inwardly form said first rail, said crowder bar having a narrow tapered end portion which lies against the inside of an upper portion of said first rail when in its operative position thereby functioning as a wedge so as to enter between said upper rail portion and the flange on a wheel rolling on said first rail to force the wheel toward said second rail and thereby force the opposite wheel into the entering point of said derail, the sides of said narrow tapered end portion defining an included angle not substantially exceeding 15 degrees, and actuating means for moving said crowder bar between its operative and inoperative positions, said actuating means being responsive to actuation of said derail between its operative and inoperative positions.

2. A wheel crowder for use in combination with a derail for mounting on a rail opposite the derail to assist in operation of the latter, said wheel crowder comprising, in combination, a crowder bar located along the inside of a first rail opposite a second rail on which a derail is mounted, said crowder bar having an upper surface approximately coplanar with an upper surface of said first rail, said crowder bar being movable between an operative position where it engages the inside of said first rail and an inoperative position where it is spaced inwardly from said first rail, said crowder bar having a narrow tapered end portion which lies against the inside of an upper portion of said first rail when in its operative position thereby functioning as a wedge so as to enter between said upper rail portion and the flange on a wheel rolling on said first rail to force the wheel toward said second rail and thereby force the opposite wheel into the entering point of said derail, a raiser bar fixed to the top of said crowder bar for supporting and elevating said wheel as the latter rolls off said first rail during a derailing operation, and actuating means for moving said crowder bar between its operative and inoperative positions, said actuating means being responsive to actuation of said derail between its operative and inoperative positions.

3. A wheel crowder for use in combination with a derail for mounting on a rail opposite the derail to assist in operation of the latter, said wheel crowder comprising, in combination, a crowder bar located along the inside of a first rail opposite a second rail on which a derail is mounted, said crowder bar being movable between an operative position where it engages the inside of said first rail and an inoperative position where it is spaced inwardly form said first rail, said crowder bar having a narrow tapered end portion which lies against the inside of an upper portion of said first rail when in its operative position thereby functioning as a wedge so as to enter between said upper rail portion and the flange on a wheel rolling on said first rail to force the wheel toward said second rail and thereby force the opposite wheel into the entering point of said derail, and actuating means for moving said crowder bar between its operative and inoperative positions, said actuating means being responsive to actuation of said derail between its operative and inoperative positions, said actuating means including yieldable means to permit said crowder bar to be cammed out of its operative position when engaged by the flange on a wheel rolling on said first rail from a direction opposite to said narrow tapered end portion.

4. A wheel crowder for use in combination with a sliding derail for mounting on a rail opposite the sliding derail to assist in operation of the latter, said wheel crowder comprising, in combination, a crowder bar located along the inside of a first rail opposite a second rail on which a derail is mounted, said crowder bar being movable between an operative position where it engages the inside of said first rail and an inoperative position where it is spaced inwardly from said first rail, said crowder bar having a narrow tapered end portion which lies against the inside of an upper portion of said first rail when in its operative position thereby functioning as a wedge so as to enter between said upper rail portion and the flange on a wheel rolling on said first rail to force the wheel toward said second rail and thereby force the opposite wheel into the entering point of said derail, and actuating means for moving said crowder bar between its operative and inoperative positions, said actuating means including bellcrank means connected through yieldable means to said crowder bar, and means connecting said bellcrank means with said sliding derail, whereby said actuating means is responsive to actuation of said sliding derail between its operative and inoperative positions.

5. A wheel crowder for use in combination with a hinged-type derail for mounting on a rail opposite the hinged-type derail to assist in operation of the latter, said wheel crowder comprising, in combination, a crowder bar located along the inside of a first rail opposite a second rail on which a derail is mounted, said crowder bar being movable between an operative position where it engages the inside of said first rail and an inoperative position where it is spaced inwardly from said first rail, said crowder bar having a narrow tapered end portion which lies against the inside of an upper portion of said first rail when in its operative position thereby functioning as a wedge so as to enter between said upper rail portion and the flange on a wheel rolling on said first rail to force the wheel toward said second rail and thereby force the opposite wheel into the entering point of said derail, and actuating means for moving said crowder bar between its operative and inoperative positions, said actuating means including bellcrank means connected through yieldable means to said crowder bar, and means connecting said bellcrank means with a pivotable portion of said hinged-type derail, whereby said actuating means is responsive to actuation of said hinged-type derail between its operative and inoperative positions.

6. A wheel crowder for use in combination with a derail for mounting on a rail opposite the derail to assist in operation of the latter, said wheel crowder comprising, in combination, a crowder bar located along the inside of a first rail opposite a second rail on which a derail is mounted, said crowder bar being mounted for pivotal movement about a fixed pivot shaft between an operative position where it engages the inside of said first rail and an inoperative position where it is spaced inwardly from said first rail, said crowder bar having a narrow tapered end portion which lies against the inside of an upper portion of said first rail when in its operative position thereby functioning as a wedge so as to enter between said upper rail portion and the flange on a wheel rolling on said first rail to force the wheel toward said second rail and thereby force the opposite wheel into the entering point of said derail, the sides of said narrow tapered end portion defining an included angle not substantially exceeding 15°, and actuating means for moving said crowder bar between its operative and inoperative positions, said actuating means being responsive to actuation of said derail between its operative and inoperative positions and including yieldable means to permit said crowder bar to be cammed out of its operative position when engaged by the flange on a wheel rolling on said first rail from a direction opposite to said narrow tapered end portion.

7. A wheel crowder as defined in claim 6 where said narrow tapered end portion includes a flat side wall which lies flat against the inside of said upper portion of said first rail when said crowder bar is in said operative position.

8. A wheel crowder as defined in claim 7 where said actuating means includes bellcrank means connected through said yieldable means to said crowder bar, and means connecting said bellcrank means with said derail.

* * * * *